US005225060A

United States Patent [19]

Noaki et al.

[11] Patent Number: 5,225,060

[45] Date of Patent: Jul. 6, 1993

[54] BIPOLAR, FILTER PRESS TYPE ELECTROLYTIC CELL

[75] Inventors: Yasuhide Noaki, Nobeoka; Saburo Okamoto, Higashi, both of Japan

[73] Assignee: Asahi Kasei Kogyo Kabushiki Kaisha, Osaka, Japan

[21] Appl. No.: 853,259

[22] Filed: Mar. 18, 1992

[30] Foreign Application Priority Data

Mar. 18, 1991 [JP] Japan ..... 3-052560
May 28, 1991 [JP] Japan ..... 3-123535

[51] Int. Cl.[5] ..... C25B 9/00; C25B 15/08

[52] U.S. Cl. ..... 204/237; 204/254; 204/257; 204/258

[58] Field of Search ..... 204/252–258, 204/263–266, 237

[56] References Cited

U.S. PATENT DOCUMENTS

| | | | |
|---|---|---|---|
| 4,105,515 | 8/1978 | Ogawa et al. | 204/98 |
| 4,108,742 | 8/1978 | Seko et al. | 204/98 |
| 4,108,752 | 8/1978 | Pohto et al. | 204/256 |
| 4,111,779 | 9/1978 | Seko et al. | 204/255 |
| 4,149,952 | 4/1979 | Sato et al. | 204/258 |
| 4,214,957 | 7/1980 | Ogawa et al. | 204/98 |
| 4,295,953 | 10/1981 | Fuseya et al. | 204/257 |
| 4,557,816 | 12/1985 | Yoshida et al. | 204/255 |
| 4,643,818 | 2/1987 | Seko et al. | 204/253 |
| 4,734,180 | 3/1988 | Sato et al. | 204/254 |
| 4,839,012 | 6/1989 | Burney, Jr. et al. | 204/255 |
| 5,139,635 | 8/1992 | Signorini | 204/256 |
| 5,141,618 | 8/1992 | Cabaraux et al. | 204/257 |

FOREIGN PATENT DOCUMENTS

| | | |
|---|---|---|
| 1076994 | 11/1975 | Canada . |
| 2017496 | 11/1990 | Canada . |
| 99693 | 2/1984 | European Pat. Off. . |
| 220659 | 5/1987 | European Pat. Off. . |
| 400712 | 12/1990 | European Pat. Off. . |
| 1103099 | 11/1976 | Japan . |
| 54-90079 | 7/1979 | Japan . |
| 61-19789 | 1/1986 | Japan . |
| 63-11686 | 1/1988 | Japan . |

*Primary Examiner*—Donald R. Valentine
*Attorney, Agent, or Firm*—Birch, Stewart, Kolasch & Birch

[57] ABSTRACT

Disclosed is a bipolar, filter press type electrolytic cell comprising a plurality of unit cells which are arranged in series through a cation exchange membrane disposed between respective adjacent unit cells, each unit cell containing anode-side and cathode-side gas-liquid separation chambers respectively disposed in anode-side and cathode-side non-current-flowing spaces and extending over the entire upper-side lengths of anode and cathode compartments. This electrolytic cell can be utilized to stably perform, for a prolonged period of time, the electrolysis of an aqueous alkali metal chloride solution at low cost without causing not only a leakage of an electrolytic solution but also vibration of the cell and formation of a gas zone in the upper portion of the anode and cathode compartments even in the electrolysis conducted at a high current density and at a high alkali concentration.

11 Claims, 4 Drawing Sheets

BIPOLAR, FILTER PRESS TYPE ELECTROLYTIC CELL

BACKGROUND OF THE INVENTION

1. Field of the Invention

The present invention relates to a bipolar, filter press type electrolytic cell. More particularly, the present invention is concerned with a bipolar, filter press type electrolytic cell for the production of chlorine and an alkali metal hydroxide by electrolyzing an aqueous alkali metal chloride solution. The electrolytic cell comprises a plurality of unit cells which are arranged in series through a cation exchange membrane disposed between respective adjacent unit cells, each unit cell containing anode-side and cathode-side gas-liquid separation chambers respectively disposed in anode-side and cathode-side non-current-flowing spaces and extending over the entire upper-side lengths of anode and cathode compartments. The filter press type electrolytic cell of the present invention can be utilized to stably perform the electrolysis of an aqueous alkali metal chloride solution at a low cost and with great advantages in that not only does leakage of an electrolytic solution not occur, but a good circulation of the electrolytic solution within the anode and cathode compartments is also assured over a wide range of the internal pressure of the cell. Also a vibration of the cell and formation of a gas zone in the upper portion of each of the anode and cathode compartments are effectively prevented even at a high current density and at a high alkali concentration, so that occurrence of breakage of and pinhole formation in the ion exchange membrane can be effectively prevented.

2. Discussion of Related Art

Many proposals have heretofore been made with respect to the process for the electrolysis (hereinafter frequently referred to as "ion exchange membrane method electrolysis") of an alkali metal chloride using an ion exchange membrane for the production of a high purity alkali metal hydroxide at high current efficiency. For example, U.S. Pat. No. 4,108,742 discloses a method in which the electrolysis is conducted while maintaining the internal pressure of the cathode compartment at a level higher than the internal pressure of the anode compartment; Japanese Patent Application Laid-Open Specification No. 51-103099 discloses a method in which a mineral acid is incorporated into an anolyte and the electrolysis is conducted while maintaining at 3.5 or less a pH value of the saline solution present in the anode compartment; U.S. Pat. No. 4,105,515 discloses a method in which the electrolysis is conducted while maintaining the pressures of a halogen gas in the anode compartment and a hydrogen gas in the cathode compartment at a superatmospheric pressure; and U.S. Pat. No. 4,214,957 discloses a method in which the electrolysis is conducted while a fresh saline solution to be supplied and/or a low concentration saline solution to be recycled are allowed to absorb hydrogen chloride gas. These methods are effective for lowering an electrolysis voltage or decreasing the oxygen concentration of an evolved chlorine gas. However, these methods are not satisfactory from the viewpoint of effectively conducting the electrolysis without formation of a gas zone in the anode and cathode compartments even at a high current density while preventing the vibration of the cell. The vibration of the cell leads to breakage of an ion exchange membrane. Further, as will be described later in detail, formation of a gas zone in the anode and cathode compartments leads to pinhole formation in and breakage of an ion exchange membrane.

With respect to the conventionally proposed electrolytic cells for the electrolysis of an alkali chloride, reference can be made, for example, to U.S. Pat. No. 4,111,779 in which an electrical connection between anode and cathode compartments in a unit cell is established by spot welding through an explosion-bonded titanium-iron plate; U.S. Pat. No. 4,108,752 in which an electrical connection between anode and cathode compartments in a unit cell is established by means of a spring type connector; Canadian Patent No. 1076994 in which an electrolytic cell is made from a plastic, and an electrical connection between anode and cathode compartments in a unit cell is established by means of bolts and nuts; and Japanese Patent Application Laid-Open Specification No. 54-90079 in which an electrical connection between anode and cathode compartments in a unit cell is established by bonding titanium as a material of an anode-side partition wall and stainless steel as a material of a cathode-side partition wall through a copper plate by ultrasonic welding. These conventional electrolytic cells are improved in the construction of electrolytic cells and in the reduction of electrical resistance between anode and cathode compartments in a unit cell. However, in these conventional electrolytic cells, no special consideration is given for solving the problems which are encountered when electrolysis is conducted at a high current density, i.e., the problems of vibration of the cell, occurrence of uneven concentration distribution of an electrolyte (solute) within electrode compartments and formation of a gas zone in the upper portion of the electrode compartments. The unevenness in the concentration of an electrolyte is caused by poor circulation of the electrolytic solution, and is likely to adversely affect the desired performance of an ion exchange membrane.

In U.S. Pat. No. 4,557,816, a duct is provided in electrode compartments to thereby improve the uniformity of the electrolyte concentration in the electrode compartments, but there are drawbacks in that vibration of the cell and formation of a gas zone in the upper portion of the electrode compartments occur when electrolysis is conducted at a high current density.

On the other hand, U.S. Pat. No. 4,643,818 discloses an electrolytic cell which can be used as either of a monopolar type cell and a bipolar type cell, and U.S. Pat. No. 4,734,180 (corresponding to EP No. 0 220 659 B1) discloses an electrolytic cell in which each unit cell is provided by disposing an anode-side pan-shaped body and a cathode-side pan-shaped body back to back, each pan-shaped body comprising a partition wall, a frame wall extending from the periphery of the partition wall and upper and lower hooked flanges, respectively, extending from the upper-side and lower-side portions of the frame wall, and fittedly inserting an upper and lower engaging bars, respectively, into upper and lower through-spaces which are, respectively, formed between the upper-side portions of the frame wall and the upper hooked portions and between the lower-side portions of the frame wall and the lower hooked portions when both pan-shaped bodies are disposed and fastened back to back. The above-mentioned two U.S. patents are advantageous in that not only can the number of welded portions be reduced and no leakage of an electrolytic solution occurs even at a high internal pressure of the cell, but also the assembling of each unit cell can be conducted easily and at low cost. However, the electrolytic cells of the above U.S. patents are unsatisfactory with respect to the circulation of an electrolytic solution within electrode compartments and to the prevention of formation of gas zone and of vibration of the cell when it is desired to stably conduct electrolysis under operation conditions such that the internal pressure varies over a wide range from a superatmospheric pressure to a reduced pressure or when it is desired to stably conduct electrolysis at a current density as high as 45 A/dm$^2$ or more.

Further, Japanese Patent Application Laid-Open Specification No. 61-19789 and U.S. Pat. No. 4,295,953 disclose an electrolytic cell in which a cell frame has a hollow structure and is of a picture frame-like shape, and an electrically conductive spacer is disposed between an electrode plate and an electrode sheet, the spacer being intended to serve as a path for the downward flow of an electrolytic solution. Japanese Patent Application Laid-Open Specification No. 63-11686 discloses an electrolytic cell in which a cell frame has a hollow structure and is of a picture frame-like shape, and a cylindrical member for electrical current distribution is provided, the cylindrical member being intended to serve as a path for the downward flow of an electrolytic solution. In these prior art techniques, an improved circulation of an electrolytic solution in electrode compartments can be attained, but when electrolysis is conducted at a high current density, it is likely that vibration occurs around an outlet for liquid and gas and that a gas zone is formed in the upper portion of the electrode compartments. Further, in these techniques, disadvantages are likely to be encountered such that when it is attempted to increase the internal pressure of the cell, the strength of the cell is unsatisfactory; that a leakage of an electrolytic solution occurs; and that when it is attempted to conduct electrolysis while adding hydrochloric acid into a fresh electrolytic solution (in order to prevent an increase in the oxygen concentration of evolved chlorine gas and prevent formation of chlorate), the voltage of the ion exchange membrane is increased.

Thus, although many conventional techniques were proposed for effectively and efficiently conducting the ion exchange membrane method electrolysis of an alkali metal chloride, no conventional proposal is satisfactory in meeting the recent demand for the prevention of occurrence of vibration of the cell during the electrolysis and demand for the capability of conducting electrolysis at an advantageously low voltage even at a current density as high as 45 A/dm$^2$ or more, i.e., demand for high efficiency, power consumption saving and the like.

SUMMARY OF THE INVENTION

The present inventors have made extensive and intensive studies with a view toward developing an electrolytic cell which is free from the above-mentioned problems accompanying the conventional electrolytic cells and which can enjoy the great advantages of a bipolar, filter press type electrolytic cell (which can be constructed easily through relatively simple working and at low cost) and which not only exhibits no leakage of an electrolytic solution, but also can assure a good circulation of the electrolytic solution in the anode and cathode compartments over a wide range of internal pressure from a superatmospheric pressure to a reduced pressure during the electrolysis and does not exhibit vibration and gas zone formation in the upper portion of electrode compartments even during the electrolysis conducted at a high current density and at a high alkali concentration, thereby enabling stable electrolysis for a prolonged period of time. As a result, unexpectedly, the present inventors have found that the desired electrolytic cell can be obtained by the disposition of anode-side and cathode-side gas-liquid separation chambers in anode-side and cathode-side non-current-flowing spaces over the entire upper-side lengths of the anode and cathode compartments. The present invention has been completed on the basis of this finding.

Accordingly, it is an object of the present invention to provide a novel electrolytic cell which is suitable for stably conducting, for a prolonged period of time, the electrolysis of an alkali metal chloride with a good circulation of the electrolytic solution in the electrode compartments over a wide range of internal pressure and without causing not only a leakage of an electrolytic solution but also vibration of the cell and formation of a gas zone in the upper portion of the electrode compartments even in the electrolysis conducted at a high current density and at a high alkali concentration.

It is another object of the present invention to provide a method for the electrolysis of an alkali metal chloride using the above-mentioned electrolytic cell, which can be performed stably for a prolonged period of time and at low cost.

The foregoing and other objects, features and advantages of the present invention will be apparent from the following detailed description and appended claims.

BRIEF DESCRIPTION OF THE DRAWINGS

In the drawings:

In FIGS. 1 through 4, like parts or portions are designated by like numerals or characters.

DETAILED DESCRIPTION OF THE INVENTION

Figure 1:
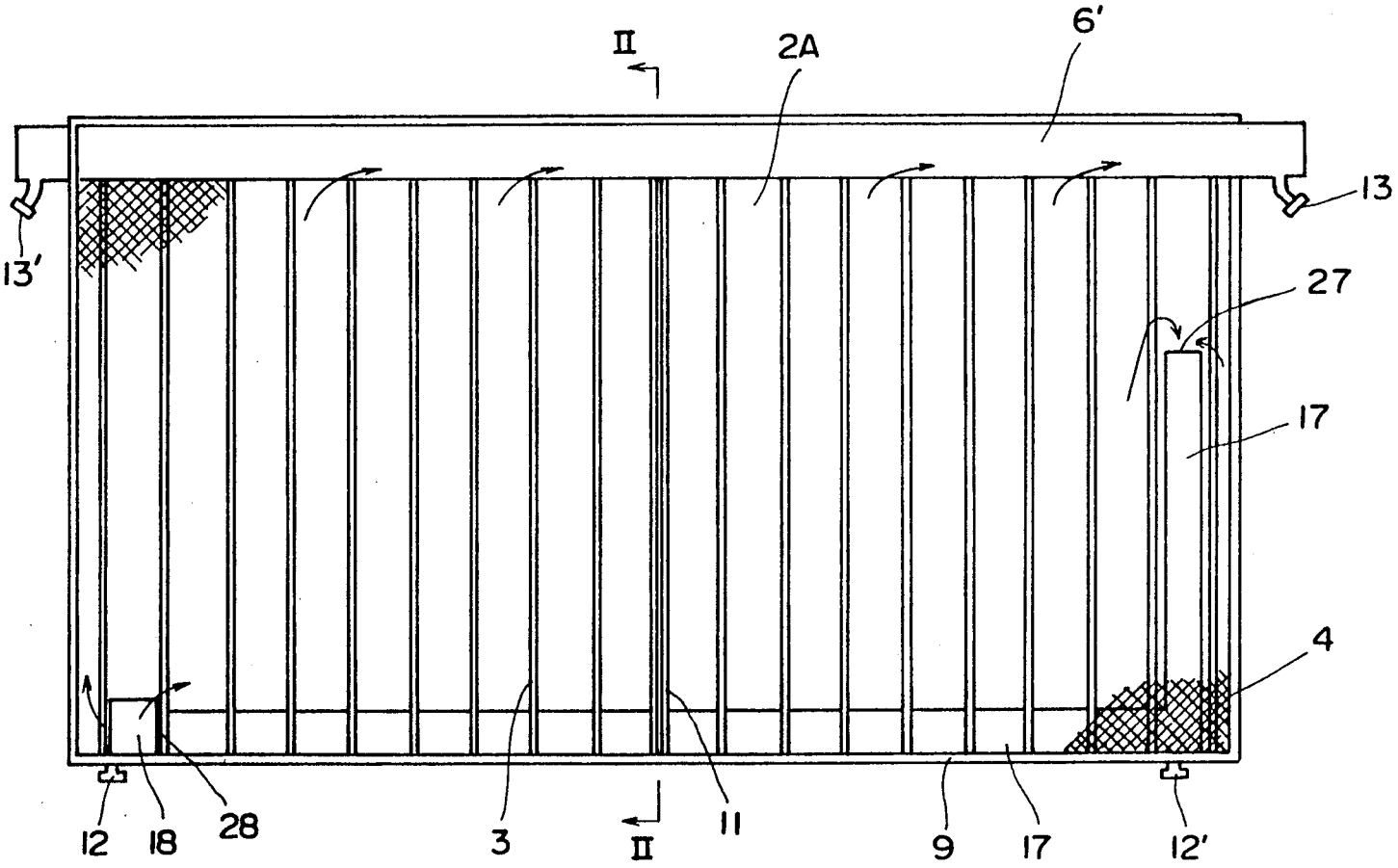
FIG. 1 is a diagrammatic front view of a unit cell used in the electrolytic cell of the present invention as viewed from the anode compartment side, shown with the net-like electrode substantially cut-away.

Essentially, according to the present invention, there is provided a bipolar, filter press type electrolytic cell comprising a plurality of unit cells which are arranged in series through a cation exchange membrane disposed between respective adjacent unit cells, each unit cell comprising:

(A) an anode-side pan-shaped body, and (B) a cathode-side pan-shaped body, each of the pan-shaped bodies (A) and (B) comprising a partition wall, a frame wall extending from the periphery of the partition wall, and upper and lower crooked flanges having a -shaped cross-section and, respectively, extending from the upper-side and lower-side portions of the frame wall, the upper and lower crooked flanges cooperating with the upper-side and lower-side portions of the frame wall, respectively, to thereby form upper and lower recesses, the pan-shaped body (A) and pan-shaped body (B) being disposed back to back, to thereby form upper and lower through-spaces, respectively, defined by the upper recesses of the pan-shaped bodies (A) and (B) and the lower recesses of the pan-shaped bodies (A) and (B), the partition wall of the pan-shaped body (A) having an anode fixed thereto through a plurality of electrically conductive ribs to form an anode compartment with an anode-side non-current-flowing space left above the anode compartment and below the upper-side portion of the frame wall of the pan-shaped body (A), the partition wall of the pan-shaped body (B) having a cathode fixed thereto through a plurality of electrically conductive ribs to form a cathode compartment with a cathode-side non-current-flowing space left above the cathode compartment and below the upper-side portion of the frame wall of the pan-shaped body (B), (C) upper and lower engaging bars fittedly disposed in the upper and lower through-spaces, respectively, and serving to fasten the pan-shaped bodies (A) and (B) back to back, and (D) an anode-side gas-liquid separation chamber disposed in the anode-side non-current-flowing space and extending over the entire upper-side length of the anode compartment, and a cathode-side gas-liquid separation chamber disposed in the cathode-side non-current-flowing space and extending over the entire upper-side length of the cathode compartment, the anode-side and cathode-side gas-liquid separation chambers having perforated bottom walls partitioning the anode-side and cathode-side gas-liquid separation chambers from the anode compartment and the cathode compartment, respectively.

In general, for performing the electrolysis of an alkali metal chloride stably and at low cost, it is necessary that an electrolytic cell or a method for electrolysis satisfy requirements such that the cost of equipment be low, that electrolytic voltage be low, that there occurs no vibration which is likely to cause an ion exchange membrane to be broken and that not only be the concentration distribution of an electrolytic solution in an electrode compartment narrow, but also that no formation of a gas zone occurs in the upper portion of an electrode compartment, thereby causing the voltage and the current efficiency of an ion exchange membrane to be stable for a prolonged period of time.

Further, it is noted that these requirements have been increasingly becoming strict according to the current trend of less cost for equipment, energy saving and pursuing efficiency.

For example, due to the increase in the price of electricity, it has recently become a practice that in the daytime when the price of electricity is high, electrolysis is conducted at a current density as low as possible with smaller power consumption and in the nighttime when the price of electricity is low, electrolysis is conducted at a current density as high as possible with greater power consumption. Thus, it has been strongly desired to raise the maximum value of the current density for taking advantage of the cheap nighttime supply of electricity.

However, conventionally, in the electrolysis of an alkali metal chloride, the maximum current density is usually in the range of from 30 to 40 $A/dm^2$. If electrolysis can be conducted at a higher current density, the equipments including an electrolyzer can be advantageously reduced in size, enabling a construction cost to be decreased, but on the other hand, there is inevitably a disadvantage in that a power cost is increased. If electrolysis is conducted at a lower current density, the cost for equipments including an electrolyzer is increased although a power cost is lowered.

The electrolytic cell of the present invention as well as the unit cell thereof can be assembled at low cost, and hence the equipment cost is extremely low. Further, in electrolysis using the electrolytic cell of the present invention, a current density can be selected in the wide range of 45 $A/dm^2$ or higher to 10 $A/dm^2$ or lower, without occurrence of vibration of the cell and formation of a gas zone in the anode and cathode compartments. Moreover, the internal pressure of the cell can also be selected in a wide range, and the electrolytic voltage can be controlled to a minimum.

Examples of alkali metal chlorides which can be electrolyzed using the electrolytic cell of the present invention include sodium chloride, potassium chloride, lithium chloride and the like. Of these, sodium chloride is commercially most important.

Preferred embodiments of the present invention will now be illustratively described with reference to FIGS. 1 to 4, taking as example the electrolysis of sodium chloride. The present invention, however, is not limited to the following embodiments.

The bipolar, filter press type electrolytic cell of the present invention comprises a plurality of unit cells 25 which are arranged in series through cation exchange membrane 19 disposed between respective adjacent unit cells as described below with reference to FIG. 4.

Figure 2:
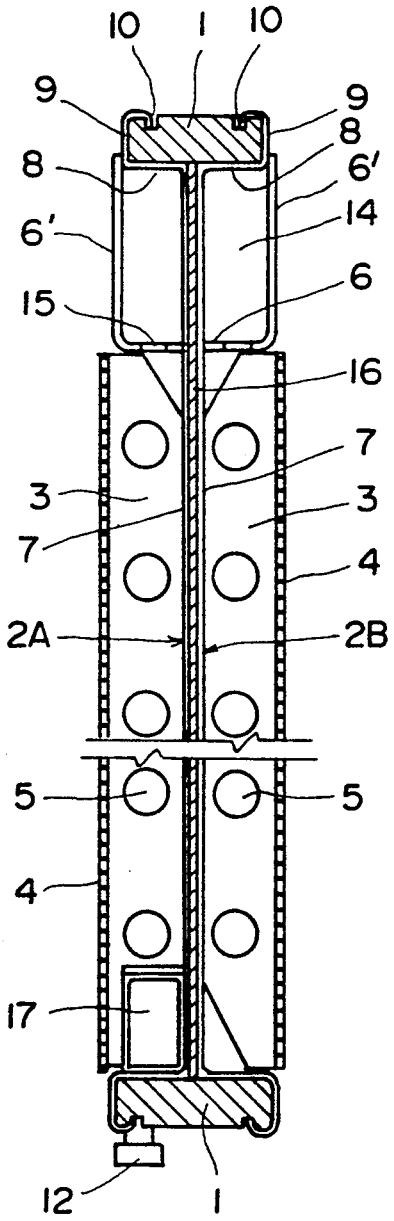
FIG. 2 is an enlarged, diagrammatic cross-sectional view of FIG. 1, taken along line II—II of FIG. 1.

In FIG. 1, there is shown a diagrammatic front view of a unit cell used in the electrolytic cell of the present invention as viewed from the anode compartment side, shown with the net-like electrode substantially cutaway. FIG. 2 shows an enlarged, diagrammatic cross-sectional view of FIG. 1, taken along line II—II thereof.

In FIGS. 1 and 2, numeral 1 designates an engaging bar, numeral 2A an anode-side pan-shaped body, numeral 2B a cathode-side pan-shaped body, numeral 3 a conductive rib, numeral 4 an electrode, numeral 5 a hole, numeral 6 a perforated bottom wall, numeral 6' a side wall, numeral 7 a partition wall, numeral 8 a frame wall, numeral 9 a crooked flange, numeral 10 a hooked tip, numeral 11 a reinforcing rib, numeral 12 an inlet nozzle of an anode compartment, numeral 12' an inlet nozzle of a cathode compartment, numeral 13 an outlet nozzle of an anode compartment, numeral 13' an outlet nozzle of a cathode compartment, numeral 14 a gas-liquid separation chamber, numeral 15 a hole (perforation), numeral 16 an explosion-bonded portion, numeral 17 duct means, numeral 18 a mixing box, numeral 27 an upper opening of duct means and numeral 28 a lower opening of duct means.

In the present invention, "unit cell" means a bipolar type single cell comprised of two sections, namely, an anode-side section and a cathode-side section. The anode-side section comprises an anode compartment and, disposed thereon, an anode-side gas-liquid separation chamber. The cathode-side section comprises a cathode compartment and, disposed thereon, a cathode-side gas-liquid separation chamber. The anode-side section and cathode-side section are disposed back to back. More specifically, as shown in FIG. 2, each unit cell comprises an anode-side pan-shaped body 2A and a cathode-side pan-shaped body 2B.

Figure 3:
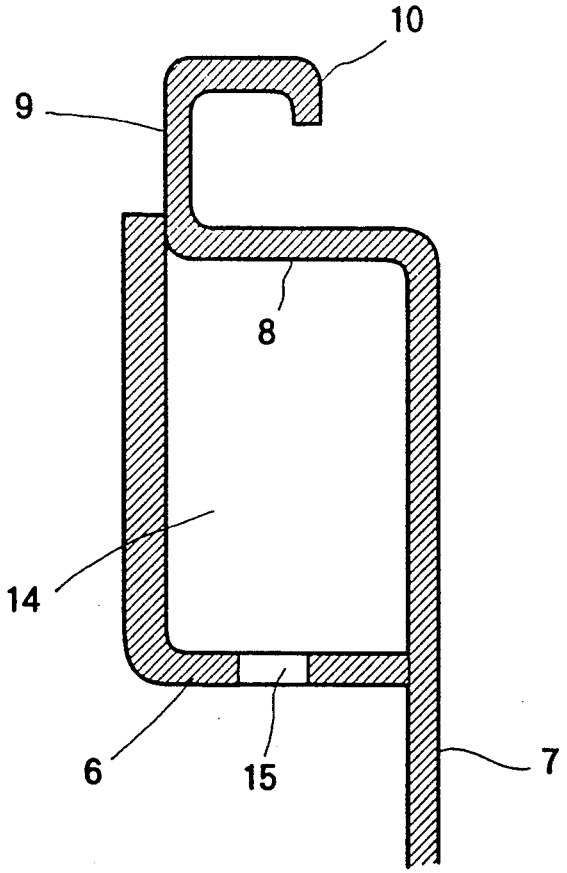
FIG. 3 is an enlarged, diagrammatic cross-sectional view of the upper portion of a pan-shaped body comprising a partition wall, a frame wall extending from the periphery of the partition wall, and an upper crooked flange extending from the upper-side portion of the frame wall, together with a gas-liquid separation chamber having a perforated bottom wall.

FIG. 3 is an enlarged, diagrammatic cross-sectional view of the upper portion of a pan-shaped body comprising a partition wall, a frame wall extending from the periphery of the partition wall, and an upper crooked flange extending from the upper-side portion of the frame wall, together with a gas-liquid separation chamber having a perforated bottom wall.

In FIG. 3, numeral 6 designates a bottom wall, numeral 7 a partition wall, numeral 8 a frame wall, numeral 9 a crooked flange, numeral 10 a hooked tip, numeral 14 a gas-liquid separation chamber and numeral 15 a hole (perforation).

As shown in FIGS. 2 and 3, each of anode-side and cathode-side pan-shaped bodies 2A, 2B comprises partition wall 7, frame wall 8 extending from the periphery of partition wall 7, and upper and lower crooked flanges 9,9 having a ⌐-shaped cross-section and respectively extending from the upper-side and lower-side portions of frame wall 8.

Upper and lower crooked flanges 9,9 cooperate with the upper-side and lower-side portions of frame wall 8, respectively, to thereby form upper and lower recesses.

A space defined by frame wall 8 and partition wall 7 serves to form therein not only an anode compartment (or a cathode compartment) but also anode-side (or cathode-side) gas-liquid separation chamber 14. The width in cross-section of frame wall 8 corresponds to the lateral depth of each of the anode and cathode compartments. The height of partition wall 7 corresponds to the total of the height of the anode (or cathode compartment) and the height of gas-liquid separation chamber 14. The longitudinal length of partition wall 7 of pan-shaped body 2A (shown in FIG. 1) corresponds to the longitudinal length of each of the anode and cathode compartments.

As shown in FIG. 2, anode-side pan-shaped body 2A and cathode-side pan-shaped body 2B are disposed back to back, to thereby form upper and lower through-spaces, respectively, defined by the upper recesses of the pan-shaped bodies 2A, 2B and the above-mentioned lower recesses of the pan-shaped bodies 2A, 2B.

Partition wall 7 of the pan-shaped body 2A has anode 4 fixed thereto through a plurality of electrically conductive ribs 3 to form an anode compartment with an anode-side non-current-flowing space left above the anode compartment and below the upper-side portion of frame wall 8 of the pan-shaped body 2A.

Partition wall 7 of pan-shaped body 2B has a cathode fixed thereto through a plurality of electrically conductive ribs 3 to form a cathode compartment with a cathode-side non-current-flowing space left above the cathode compartment and below the upper-side portion of frame wall 8 of the pan-shaped body 2B.

Further, reinforcing rib 11 may optionally be provided in each of pan-shaped bodies 2A, 2B (as shown in FIG. 1).

Upper and lower engaging bars 1,1 are fittedly disposed in the above-mentioned upper and lower through-spaces, respectively, and serve to fasten pan-shaped bodies 2A, 2B back to back in accordance with the back-to-back disposition of pan-shaped bodies 2A, 2B. In this connection, it should be noted that crooked flange 9 preferably has hooked tip 10 as shown in FIGS. 2 and 3, which is fittedly inserted into a groove formed in each engaging bar 1.

These two pan-shaped bodies 2A, 2B may or may not be welded to form a unified structure. However, a unified structure formed by welding is preferred because of a lower electric resistance. The method for welding is not particularly limited. Examples of welding methods include a method in which a pair of pan-shaped bodies are directly connected back to back by ultrasonic welding and a method in which a pair of pan-shaped bodies are connected back to back by spot welding through an explosion-bonded titanium-iron plate formed.

There is no particular limitation with respect to a material for producing each of pan-shaped bodies 2A, 2B, conductive rib 3 and optional reinforcing rib 11, as long as the material exhibits corrosion resistance under the electrolysis conditions. Examples of materials usable for anode-side pan-shaped body 2A and the corresponding rib 3 and reinforcing rib 11 include titanium and a titanium alloy, and examples of materials usable for the cathode-side pan-shaped body 2B and the corresponding rib 3 and reinforcing rib 11 include iron, nickel, and stainless steel.

With respect to the thickness of the material for each of pan-shaped bodies 2A, 2B, there is no particular limitation as long as not only does the thickness allow fabrication of the material by bending, but also the thickness is sufficient for standing an internal pressure of the cell and also sufficient for welding to connect conductive rib 3 thereto. In general, the preferred thickness is in the range of from about 1 to about 3 mm. A plurality of conductive ribs 3 are welded to each of pan-shaped bodies 2A, 2B, and each of ribs 3 has holes 5 for the passage of a liquid and gas therethrough. These holes 5 allow the passage of an electrolytic solution and an electrolysis product. The optional reinforcing rib 11 also has holes. The width of conductive rib 3 is chosen so that the gap between ion exchange membrane 19 and electrode 4 would become zero or almost zero, taking into consideration the length in cross-section of frame wall 8, the thickness of each of gaskets 20 and 21 for sealing, and the thickness of electrode 4. Electrode 4 is connected to rib 3.

The engaging bar 1 has a cross-section such that it can be fittedly disposed in each of the upper and lower through-spaces defined by the upper and lower recesses of anode-side pan-shaped body 2A and cathode-side pan-shaped body 2B. The surface of the engaging bar 1 may preferably be protected with a rubber lining, epoxy resin coating or the like from the viewpoint of electric insulation and corrosion prevention. With respect to the material for engaging bar 1, there may be mentioned metals such as iron, stainless steel and the like and plastics such as polyethylene, polypropylene, polyvinyl chloride and the like. Of these, a metallic material is preferred from the viewpoint of attaining high strength of the electrolytic cell. Engaging bar 1 may be either solid or hollow. However, solid engaging bar 1 is preferred from the viewpoint of attaining high strength.

The unit cell used in the electrolytic cell of the present invention can be very easily assembled at low cost.

That is, the main body of the unit cell can be produced simply by disposing a pair of pan-shaped bodies 2A,2B back to back and fittedly inserting engaging bars 1,1 into the upper and lower through-spaces defined by the upper and lower recesses of pan-shaped bodies 2A,2B. In addition, each of pan-shaped bodies 2A,2B can be prepared from a single plate. Therefore, the unit cell used in the present invention is advantageous not only in that the number of welded portions is very small so that strain due to the welding is prevented but also in that there is no danger of leakage of an electrolytic solution even at a high internal pressure.

The structure of the unit cell used in the electrolytic cell of the present invention is substantially the same as the structure of the unit cell disclosed in U.S. Pat. No. 4,734,180 (corresponding to EP No. 0 220 659 B1), except that the unit cell in the present invention has anode-side and cathode-side gas-liquid separation chambers.

In the present invention, anode-side gas-liquid separation chamber 14 is disposed in the anode-side non-current-flowing space, which chamber 14 extends over the entire upper-side length of the anode compartment, and cathode-side gas-liquid separation chamber 14 is disposed in the cathode-side non-current-flowing space, which chamber 14 extends over the entire upperside length of the cathode compartment. The gas-liquid separation chamber 14 is intended to serve for separating a gas (in the form of bubbles) evolved on the surface of the electrode from the electrolytic solution, thereby smoothly and effectively withdrawing both the gas and the liquid.

In the present invention, "non-current-flowing space" means a space which is disposed above each electrode compartment and which does not participate in the electrolysis.

Anode-side and cathode-side gas-liquid separation chambers 14,14 have perforated bottom walls 6,6 partitioning anode-side and cathode-side gas-liquid separation chambers 14,14 from the anode compartment and the cathode compartment, respectively. Each perforated bottom wall 6 has at least one perforation or hole 15. Bottom wall 6 is effective for preventing the ascending gas bubbles and the excessive rising waves and flow of liquid (caused by the ascending gas bubbles) from directly, adversely affecting the gas-liquid separation chamber. As shown in FIG. 3, gas-liquid separation chamber 14 having perforated bottom wall 6 can be formed by bending a metallic plate having a perforated structure into an L-shape and connecting the L-shaped plate to the upper side of the pan-shaped body so that the perforated section forms bottom wall 6. Alternatively, the gas-liquid separation chamber can be formed by attaching a hollow structure, which has been previously produced, below the upper-side portion of the frame wall 6 of the pan-shaped body and above the electrode chamber.

Inside gas-liquid separation chamber 14, the liquid and gas are flowing toward a gas and liquid outlet nozzle (13 and 13' for anode-side and cathode-side gas-liquid separation chambers, respectively, as depicted in FIG. 1). In FIG. 1, outlet nozzle 13 is attached to one end of anode-side gas-liquid separation chamber 14 and outlet nozzle 13' is attached to one end of cathode-side gas-liquid separation chamber 14 located behind (not seen). Due to the pressure loss caused by the flow in gas-liquid separation chamber 14, a pressure difference occurs between both ends of gas-liquid separation chamber 14, thereby causing the level of liquid to be different as between both ends of chamber 14. In this instance, when the cross-sectional area (which is an area defined by frame wall 8, partition wall 7, side wall 6' and bottom wall 6) of gas-liquid separation chamber 14 is too small, the difference between the levels of the liquid at both ends of gas-liquid separation chamber 14 becomes too large, so that the level of the liquid on the side opposite to the side of outlet nozzle 13 is lowered below the bottom of gas-liquid separation chamber 14, that is, lowered to within the electrode compartment, thus causing a gas zone to be formed in the upper portion of the electrode compartment, which is likely to adversely affect the ion exchange membrane. Especially when a gas zone is formed in the anode compartment, it is likely that formation of crystals of an alkali metal chloride occurs in the ion exchange membrane due to the neutralization reaction of chlorine gas diffused from the anode side into the ion exchange membrane with alkali penetrated from the cathode side into the ion exchange membrane. The crystals formed within the ion exchange membrane gradually grow and eventually break the ion exchange membrane from inside to form pinholes and rupture, so that not only is the current efficiency lowered but also the life of the ion exchange membrane is shortened, and, in some cases, a serious accident may occur, such as an explosion, due to the mixing of hydrogen gas and chlorine gas. Such phenomena due to crystal formation in the ion exchange membrane become serious with the increase in the alkali concentration of the catholyte, because the higher the alkali concentration of the catholyte, the higher the concentration of the alkali diffused from the cathode side into the ion exchange membrane. In general, a gas zone is likely to be formed in the upper portion of an electrode compartment, because the gas evolved on the electrode ascends upward and the gas quantity is increased in the upper portion. Especially when the withdrawal of a gas and electrolytic solution is insufficient, the formation of a gas in the upper portion of the electrode compartment becomes marked due to the increased local stagnation of the evolved gas.

The above-mentioned problems have been successfully solved by the present invention. That is, when anode-side and cathode-side gas-liquid separation chambers 14,14 are, respectively, provided in the anode-side and cathode-side non-current-flowing spaces (formed below the upper-side portion of frame walls 8,8 of pan-shaped bodies 2A, 2B) over the entire upper-side lengths of anode and cathode compartments 22 and 23, the unfavorable formation of a gas zone in the upper portion of each electrode compartment can be effectively prevented to thereby avoid vibration of the electrolytic cell even when the electrolysis is conducted at a high temperature and at a high current efficiency.

The present inventors have made further studies on the relationship between the cross-sectional area of the gas-liquid separation chamber and the liquid level difference between both ends of the gas-liquid separation chamber in order to find more preferred conditions for attaining the object of the present invention. As a result, it has been found that the liquid level difference between both ends of the gas-liquid separation chamber is far larger than the liquid level difference expected from the pressure loss determined by calculation. In a gas-liquid separation chamber having a given cross-sectional area, pressure loss occurs due to the passage of a gas therethrough depending on the flow rate of the gas. The pressure loss can be determined by calculation based on Fanning's equation, which is well known. However, the present inventors noticed that at an electrolysis temperature of 85 ° C. or higher, the liquid level difference between both ends of the gas-liquid separation chamber is 10 to 100 times that expected from the pressure loss value obtained by calculation based on the Fanning's equation, assuming that the gas-liquid separation chamber is a tube having a smooth inner wall surface. It was also noticed that the level of liquid in the gas-liquid separation chamber is lowest around an end opposite to the end having outlet nozzle 13 and highest around the end having outlet nozzle 13.

When the gas-liquid separation chamber is partitioned from the electrode compartment by means of a relatively thin plate (bottom wall 6) having a thickness, for example, of 10 mm or less and the opening of liquid outlet nozzle 13 is positioned at a level of bottom wall 6 or lower, even if the liquid level difference as between both ends of the gas-liquid separation chamber is as small as 1 to 3 cm, it is possible that no liquid is present at an end of the gas-liquid separation chamber opposite to the end having outlet nozzle 13 or 13', so that a gas zone is formed in the upper portion of the electrode compartment.

As mentioned above, further studies have been made with a view toward discovering conditions for assuring that the liquid level difference between both the ends of the gas-liquid separation chamber is not greater than 1 cm and that the liquid level in the gas-liquid separation chamber is uniform and the liquid flow is steady throughout the entire length thereof. As result, it has been found that when the pressure of a gaseous phase in the gas-liquid separation chamber is not smaller than $-200$ mm·$H_2O$, and the gas-liquid separation chamber has a cross-sectional area of not smaller than 15 $cm^2$, the liquid level difference can be held down to not greater 1 cm and the liquid level in the gas-liquid separation chamber is uniform and the liquid flow is steady throughout the entire length thereof. Further, it has also been found that when the above conditions are fulfilled, the gas-liquid separation chamber can satisfactorily suppress the occurrence of vibration caused by the rising waves of the liquid and gas bubbles, the waves being generated by the ascending of the evolved gas. Still further, surprisingly, it has also been found that when the gas-liquid separation chamber has a portion where no liquid is present, thus forming a gas zone in the upper portion of the electrode compartment, the electrolytic solution disadvantageously has a broad concentration distribution of an alkali metal chloride, whereas when the liquid level is uniform and the liquid flow is steady in the gas-liquid separation chamber, the electrolytic solution advantageously has a narrow concentration distribution of an alkali metal chloride.

With respect to the size of the cross-section of the gas-liquid separation chamber, it is preferred that the gas-liquid separation chamber have a vertical length in cross-section in the range of from 4.0 cm to 10.0 cm and a lateral length in cross-section which is greater than 1.5 cm but less than the lateral depth of the electrode compartment as depicted in FIG. 2, and that the cross-sectional area be not smaller than 15 $cm^2$. In general, too large a cross-sectional area of a gas-liquid separation chamber leads to too large a size of an electrolytic cell, resulting in disadvantages in that construction cost and weight of the electrolytic cell become large. Thus, from the practical viewpoint, it is preferred that the cross-sectional area of the gas-liquid separation chamber be not greater than 30 $cm^2$, but the cross-sectional area is not limited to this range.

The longitudinal length of the gas-liquid separation chamber extending along the upper-side length of the electrode compartment is at least the same as the longitudinal length of the electrode compartment. However, from the viewpoint of ease in attachment of outlet nozzle 13, it is preferred that the length of the gas-liquid separation chamber be longer than the longitudinal length of the electrode compartment, as depicted in FIG. 1. In the unit cell used in the electrolytic cell of the present invention, the longitudinal length of the electrode compartment is in the range of from 200 to 400 cm and the vertical length of the electrode compartment is in the range of from 100 to 200 cm.

Bottom wall 6 of gas-liquid separation chamber 14 has perforation 15 which is adapted to allow passage of a gas and liquid therethrough without a pressure loss. It is preferred that bottom wall 6 of the gas-liquid separation chamber have a thickness in the range of from 1.0 to 10 mm, from the viewpoint of attaining both ease in fabrication and satisfactory strength. The shape of perforation 15 is not particularly limited and may be, for example, circular, elliptic, polygonal or slit. Perforation 15 may comprise a plurality of holes provided at regular or irregular intervals in bottom wall 6 of the gas-liquid separation chamber. The perforation ratio of bottom wall 6 can be selected depending on the current density and the size of the electrode compartment, but is preferably in the range of from 5 to 90%, based on the area of the bottom wall. When the perforation ratio is too small, a pressure loss may occur at the time when gas and liquid pass through holes 15 into gas-liquid separation chamber 14, so that the gas is likely to stagnate in the upper portion of the electrode compartment, forming a gas zone. The thus formed gas zone is likely to have an adverse effect on the ion exchange membrane. On the other hand, when the perforation ratio is too large, the strength of bottom wall 6, 6' of the gas-liquid separation chamber is likely to be disadvantageously low.

Discharge of the gas and liquid is conducted through outlet nozzle 13. At the time of discharge, it is possible that the gas and liquid are mixed, thus causing vibration, and it is necessary to prevent the occurrence of the vibration. For preventing the vibration, it is desired to discharge the gas and liquid from the gas-liquid separation chamber, so as not to cause a pressure loss, by maintaining a state in which at a joint portion between outlet nozzle 13 and bottom wall 6 of the gas-liquid separation chamber, the liquid flows along the inner wall surface of the nozzle while allowing the gas to flow through the center of the nozzle, without causing mixing between the gas and liquid. Further it is also desired that the gas and the liquid phases be prevented from mixing with each other not only at the joint portion between the outlet nozzle and the gas-liquid separation chamber but also at a portion of the nozzle beyond the joint portion. For preventing the gas and liquid from mixing with each other at the time of being discharged, it is preferred that the inner diameter of the outlet nozzle as measured at its portion connected to the gas-liquid separation chamber be satisfactorily large and the outlet nozzle opens downwardly of the bottom wall. Herein, "opens downwardly of the bottom wall" means that the open tip of the outlet nozzle is at a lower position than the position of the joint portion between the gas-liquid separation chamber and the outlet nozzle. When the inner diameter of the outlet nozzle is too small, the gas and liquid are likely to be mixed even when the outlet nozzle opens downwardly of the bottom wall, thus causing a pulsating flow of the liquid, resulting in vibration of the cell. This tendency of occurrence of vibration becomes greater with the increase of a current density. For conducting a stable electrolysis even at a high current density, therefore, it is preferred for the joint portion between outlet nozzle 13 and gas-liquid separation chamber 14 to have a satisfactorily large inner diameter in the range of at least 15 mm to a size which is smaller than the lateral thickness of the electrode compartment. It is also preferred that the inner diameter of the outlet nozzle at a portion other than the joint portion be not smaller than 15 mm.

The manner of flow of an electrolytic solution has a great influence on the electrolyte concentration distribution of the electrolytic solution in the electrode compartment. Generally, a fresh electrolytic solution is supplied to a lower portion of the electrolytic cell and the electrolytic solution in the cell is then withdrawn from an upper portion of the electrolytic cell. In the cell, when the movement of the electrolytic solution in the electrode compartment in a horizontal direction and vertical direction is insufficient, the concentration of the electrolyte becomes non-uniform because the electrolyte concentration of the electrolytic solution becomes low gradually during the electrolysis. Since the performance of an ion exchange membrane is greatly influenced by the concentration of the electrolytic solution, such non-uniformity in the electrolyte concentration of the electrolytic solution is likely to prevent the ion exchange membrane from exhibiting its full capability.

In order to solve the above disadvantage, it is conceivable to employ a measure in which an external tank for circulating the electrolytic solution is attached to the cell, to thereby conduct electrolysis while a large amount of an electrolytic solution is forcibly circulated between the electrolytic cell and the tank. However, such a method inevitably requires equipment other than the electrolytic cell, such as pumps, tanks and the like, so that the equipment cost becomes high.

The above-mentioned problem is satisfactorily solved by simple modification of the electrolytic cell of the present invention. That is, in a more preferred embodiment of the present invention, the unit cell further comprises, in at least one of the anode compartment and cathode compartment, at lease one duct means serving as a path for the internal circulation of an electrolytic solution and disposed between the respective partition wall and at least one of the anode and cathode. Referring to FIG. 1, vertically extending duct means 17 has its upper opening positioned below the gas-liquid separation chamber at a distance corresponding to 20 to 50% of the distance between the bottom wall and the bottom of the unit cell. In this embodiment, duct means 17 has its lower open end positioned near the bottom of the unit cell and supported by supporting means (not shown), such as a suitable hooking means fixed to partition wall 7, differing from the L-shaped structure of duct means shown in FIG. 1. The duct means facilitates spontaneous circulation of the electrolytic solution in a vertical direction and in a horizontal direction while supplying a fresh electrolytic solution in a minimum required amount in accordance with a preselected electrolytic current density value.

In another more preferred embodiment of the present invention, each unit cell further comprises, in at least one of the anode compartment and cathode compartment, at least one duct means serving as a path for the internal circulation of an electrolytic solution and disposed between the respective partition wall and at least one of the anode and cathode, the duct means being rested on the bottom of at least one of the anode compartment and cathode compartment and comprising:

a horizontal section having its opening positioned on the side of an electrolytic solution inlet nozzle; and at least one vertical section connected to the horizontal section and having an opening at its upper end positioned below the gas-liquid separation chamber by a distance of 20 to 50% of the distance between the bottom wall and the bottom of the unit cell (as depicted in FIG. 1).

Duct means 17 of this embodiment has an L-shaped configuration as illustrated in FIG. 1. That is, duct means 17 of this embodiment comprises a horizontal section and a vertical section. The horizontal section of duct means 17 is rested on the bottom of the electrode compartment and connected to the lower end of the vertical section.

In any of the above two embodiments having duct means incorporated therein, since duct means 17 has openings only at its upper and lower ends, the quantity of a gas which is evolved on the anode or cathode and comes into duct means 17, is very small. Therefore, a difference is produced in the bulk density of the electrolytic solution as between the inside and outside of duct means 17, so that the electrolytic solution on the inside of duct means 17 is caused to flow downwardly and the electrolytic solution on the outside of duct means 17 is caused to flow upwardly, thereby causing the electrolytic solution to be circulated throughout the electrode compartment. When duct means 17 is disposed in only one of the anode and cathode compartments, it is preferred to dispose duct means 17 in the anode compartment, as shown in FIGS. 1 and 2.

With respect to the embodiments additionally employing duct means, explanation is more illustratively made below with reference to FIGS. 1 and 2 in which duct means of an L-shaped configuration is used in an anode compartment. When duct means 17 is employed, the electrolytic solution enters duct means 17 from upper opening 27, which is positioned at an upper portion of the anode compartment, and then flows through the hollow portion and goes out from lower opening 28, which is positioned at the bottom of the cell. Especially in the case where duct means 17 is employed in the anode compartment, from the viewpoint of attaining a good circulation, it is preferred that upper opening 27 is positioned below the gas-liquid separation chamber 14 at a distance corresponding to 20 to 50% of the distance between the bottom wall 6 and the bottom of the anode compartment. The reason why the above range is preferred is as follows. Since the ratio of the gas to the liquid becomes higher in proportion to the distance from the bottom of the anode compartment, when the position of upper opening 27 is too high in the anode compartment, the inflow of the anolyte into the upper opening 27 of duct means 17 is unsatisfactory due to the presence of too much an increased amount of gas bubbles in the upper portion of the electrode chamber, whereas when the position of upper opening 27 is too low in the anode compartment, a difference (sufficient to cause a desired circulation of the electrolytic solution) in the bulk density of the electrolytic solution as between the outside and the inside of duct means 17, is not produced due to too small an amount of gas bubbles. If desired, from the viewpoint of improving the circulation of the electrolytic solution, duct means 17 may comprise a plurality of vertical sections and one horizontal section, wherein the vertical sections may or may not be connected to the horizontal section.

In the electrolysis of an alkali metal chloride, it is known to feed hydrochloric acid to the anode compartment in the form of a mixture with a fresh anolyte in order to prevent an increase in the oxygen concentration of chlorine gas evolved and prevent formation of chlorate. However, when hydrochloric acid is added, it is likely that the pH value of the anolyte around inlet nozzle 12 of the anode compartment becomes too low, thus causing the voltage of the ion exchange membrane to be disadvantageously elevated. From the viewpoint of solving this problem, it is preferred to dispose mixing box 18 which is connected to the lower opening 28 of duct means 17 and to inlet nozzle 12.

Therefore, in still another preferred embodiment of the present invention, the unit cell further comprises, at least in one of the anode compartment of the anode and cathode compartments, at least one duct means serving as a path for the internal circulation of an electrolytic solution and disposed between the respective partition wall and at least the anode of the anode and cathode, and comprises, in the anode compartment, a mixing box disposed at an inlet side of an electrolytic solution inlet nozzle of the anode compartment for mixing a supplied fresh electrolytic solution with a circulated electrolytic solution supplied from the duct means, wherein the mixing box is connected to the lower opening of at least one of the duct means serving as a path.

Mixing box 18 serves to mix a fresh electrolytic solution supplied from inlet nozzle 12 with a circulated electrolytic solution supplied from duct means 17. By employing mixing box 18, the above-mentioned hydrochloric acid added to the supplied fresh anolyte is diluted with a circulated anolyte. The mixing of the supplied fresh anolyte with the circulated anolyte is also useful for attaining a uniform anolyte concentration.

In this embodiment, with respect to the configuration of duct means 17, any suitable configuration may be used depending on the desired effect and the electrolysis conditions. However, in general, the L-shaped configuration shown in FIG. 1 is preferred. That is, duct means 17 comprises a vertical section and horizontal section which are connected to each other at the lower end of the vertical section and at one end of the horizontal section which is opposite to the end connected to mixing box 18. The fashion of the connection between duct means 17 and mixing box 18 is not limited and may be effected by welding or by fittedly inserting one into the other.

The shape of mixing box 18 is not limited as long as mixing box 17 is of a hollow structure which can be connected to duct means 17 and inlet nozzle 12 and which has an opening size sufficient for a mixture of a fresh electrolytic solution with a circulated electrolytic solution to smoothly flow out into the cell without pressure loss. For example, mixing box 18 may be a hollow rectangular parallelepiped made of titanium.

In the case where duct means 17 is used in the anode compartment, the material for duct means 17 may be selected from resins and titanium. From the viewpoint of processability of a material and durability, titanium is preferred. In the case where duct means 17 is used in the cathode compartment, the material for duct means 17 is selected from materials having good corrosion resistance, such as resins, stainless steel, nickel and the like.

The shape of the cross-section of duct means 17 is not limited and may be either circular or polygonal, as long as an electrolytic solution can easily flow through the duct means. With respect to the cross-sectional area of duct means 17, generally, the larger the cross-sectional area, the larger the effect of facilitating internal circulation. However, the cross-sectional area of duct means 17 is restricted by the lateral depth and structure of the electrode compartment. Thus, in general, the cross-sectional area of single duct means is preferably about 10 $cm^2$ to 50 $cm^2$. Generally, the larger the number of the duct means, the larger the effect of promoting internal circulation. However, too large a number of the duct means requires a high cost and, therefore, it is preferred to select a minimum number at which a satisfactory level of uniformity in the concentration of the anolyte or catholyte is attained.

As mentioned above, duct means 17 may be disposed in at least one of the anode compartment and cathode compartment. However, when duct means 17 is disposed in only one of both compartments, it is preferred to dispose it in the anode compartment. This is because the ratio of a gas to a liquid in the anode compartment is larger than that in the cathode compartment, so that the circulation of an electrolytic solution is more likely to be hindered by the gas bubbles in the anode compartment than in the cathode compartment.

As electrode 4, a porous, perforated or net-like metallic sheet or plate can be used. Examples of these sheets and plates include an expanded metal, a metal grid and wire gauze. The material for the anode used in the present invention may be the same as any one of those which are generally used in the electrolysis of an alkali metal chloride. That is, the anode used in the present invention can be prepared by coating a substrate comprised of a metal, such as titanium, zirconium, tantalum, niobium and alloys thereof, with an anode active material comprised mainly of an oxide of a platinum group metal, such as ruthenium oxide or the like. The material for the cathode used in the present invention can be selected from iron, nickel and an alloy thereof, and the cathode may optionally be coated with a cathode active material, such as Raney nickel, nickel rhodanide, nickel oxide or the like.

Cation exchange membrane 19 can be selected from the conventional cation exchange membranes, for example, ACIPLEX (manufactured and sold by Asahi Kasei Kogyo K.K., Japan), NAFION (manufactured and sold by E. I. Du Pont De NEMOURS AND COMPANY, U.S.A.), FLEMION (manufactured and sold by Asahi Glass Co., Ltd., Japan) or the like.

In the present invention, when the electrolysis of sodium chloride is conducted, a saline solution is used as an anolyte. The sodium chloride concentration of the saline solution may be of near saturation. The flow rate of the anolyte to be fed to the anode can be selected according to the preselected electrolytic current density and the preselected sodium chloride concentration of the anolyte within the anode compartment.

As a catholyte, a diluted sodium hydroxide is used. During the electrolysis, a fresh diluted sodium hydroxide is supplied to the cathode compartment and a produced concentrated sodium hydroxide is withdrawn from the cathode compartment.

The material for the cathode-side pan-shaped body 2B can be selected from various metals, such as stainless steel, high-nickel steel (having a nickel content of 20% by weight or more), nickel or the like. The material for the cathode may be selected not only in accordance with the type and desired concentration of a catholyte, such as sodium hydroxide, potassium hydroxide, lithium hydroxide or the like. Recently, the performance of cation exchange membranes has been markedly improved and, therefore, the concentration of sodium hydroxide to be attained in the electrolytic solution has become high. By selecting an appropriate material for the cathode, electrolysis using the electrolytic cell of the present invention can advantageously be conducted stably and at a high current density even under severe conditions such that the NaOH concentration in the cathode compartment becomes as high as about 50%.

In the embodiments explained hereinbefore, engaging bars 1,1, are disposed horizontally in the upper and lower through-spaces. However, from the viewpoint of attaining high strength of a cell, it is preferred that engaging bars 1,1 be also disposed vertically in addition to horizontal disposition.

Thus, in still another embodiment of the present invention, the frame wall of each of the pan-shaped bodies (A) and (B) has lateral crooked flanges having a ⌐-shaped cross-section and respectively extending from both lateral-side portions of the frame wall, the lateral crooked flanges cooperating with the corresponding lateral portions of the frame wall, respectively, to thereby form lateral recesses, the lateral recesses of the pan-shaped body (A) cooperating with the lateral recesses of the pan-shaped body (B) to thereby form a pair of lateral through-spaces in accordance with the back-to-back disposition of the pan-shaped bodies (A) and (B), the pair of through-spaces having engaging bars vertically, fittedly disposed therein, respectively.

Since the main body of the unit cell used in the electrolytic cell of the present invention has a simple structure comprised of an anode-side pan-shaped body 2A and, a cathode-side pan-shaped body 2B, each being fabricated from a single plate, and engaging bars 1,1, the electrolytic cell of the present invention can be prepared easily and at a low cost. Further, by virtue of the above structure, the electrolytic cell of the present invention can be operated with no danger of leakage of an electrolytic solution over a wide range of internal pressure from superatmospheric pressure of as high as 2 $kg/cm^2 \cdot G$ or higher to a reduced pressure.

Figure 4:
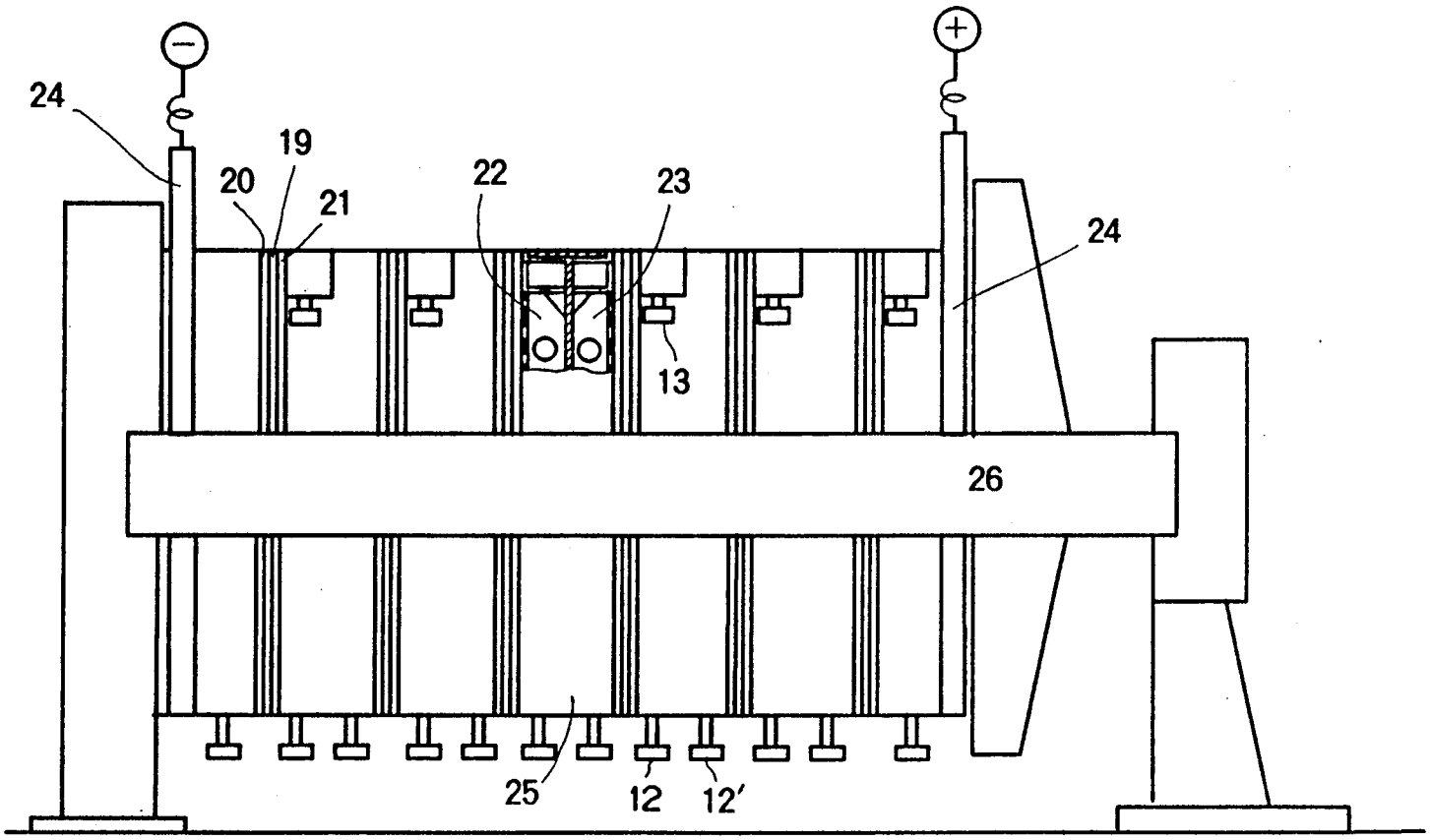
FIG. 4 is a diagrammatic side view of one embodiment of the bipolar, filter press type electrolytic cell of the present invention, which has been constructed by arranging a plurality of unit cells in series through a cation exchange membrane disposed between respective adjacent unit cells, shown with a partly broken frame wall of one unit cell in order to show the interior of the unit cell.

FIG. 4 is a diagrammatic side view of one embodiment of the bipolar, filter press type electrolytic cell of the present invention, which has been constructed by arranging a plurality of unit cells in series through a cation exchange membrane disposed between respective adjacent unit cells, shown with a partly broken frame wall of one unit cell in order to show the interior of the unit cell.

In FIG. 4, numeral 12 designates an inlet nozzle of anode compartment, numeral 12' an inlet nozzle of cathode compartment, numeral 13 an outlet nozzle of anode compartment, numeral 13' an outlet nozzle of cathode compartment, numeral 19 a cation exchange membrane, numeral 20 a cathode-side gasket, numeral 21 an anode-side gasket, numeral 22 an anode compartment, numeral 23 a cathode compartment, numeral 24 a lead plate, numeral 25 a unit cell, and numeral 26 a fastening frame.

The electrolytic cell of the present invention is constructed by arranging a plurality of unit cells 25 in series through cation exchange membrane 19 disposed between respective adjacent unit cells 25. In the embodiment shown in FIG. 4, five unit cells 25 are arranged in series through anode-side gasket 20, cation exchange membrane 19 and cathode-side gasket 21 which are disposed between respective adjacent unit cells to thereby form a stack. The stack is fastened by means of fastening frame 26. Two current lead plates 24, 24 respectively carried by two monopolar cells are disposed on both sides of the stack. Voltage is adapted to be applied to the unit cells through current lead plates 24, 24.

By using the electrolytic cell of the present invention, the electrolysis of an aqueous alkali metal chloride solution can be conducted stably and at low cost.

In the case of the conventional electrolytic cell, when electrolysis is conducted at a high current density as high as 45 $A/dm^2$ or higher, formation of a gas zone and occurrence of vibration of the cell are likely to occur. By contrast, the electrolytic cell of the present invention, in which the unit cell is equipped with gas-liquid separation chamber 14 disposed in the non-current-flowing space above each of the anode and cathode compartments is free from the gas zone formation in the upper portion of the electrode compartments and from vibration of the cell.

Accordingly, in another aspect of the present invention, there is provided a method for the electrolysis of an alkali metal chloride, which comprises electrolyzing an alkali metal chloride in a bipolar, filter press type electrolytic cell comprising a plurality of unit cells which are arranged in series through a cation exchange membrane disposed between respective adjacent unit cells, each unit cell comprising:

(A) an anode-side pan-shaped body, and (B) a cathode-side pan-shaped body, each of the pan-shaped bodies (A) and (B) comprising a partition wall, a frame wall extending from the periphery of the partition wall, and upper and lower crooked flanges having a ⌐-shaped cross-section and respectively extending from the upper-side and lower-side portions of the frame wall, the upper and lower crooked flanges cooperating with the upper-side and lower-side portions of the frame wall, respectively, to thereby form upper and lower recesses, the pan-shaped body (A) and pan-shaped body (B) being disposed back to back, to thereby form upper and lower through-spaces respectively defined by the upper recesses of the pan-shaped bodies (A) and (B) and the lower recesses of the pan-shaped bodies (A) and (B), the partition wall of the pan-shaped body (A) having an anode fixed thereto through a plurality of electrically conductive ribs to form an anode compartment with an anode-side non-current-flowing space left above the anode compartment and below the upper-side portion of the frame wall of the pan-shaped body (A), the partition wall of the pan-shaped body (B) having a cathode fixed thereto through a plurality of electrically conductive ribs to form a cathode compartment with a cathode-side non-current-flowing space left above the cathode compartment and below the upper-side portion of the frame wall of the pan-shaped body (B), (C) upper and lower engaging bars fittedly disposed in the upper and lower through-spaces, respectively, and serving to fasten the pan-shaped bodies (A) and (B) back to back, and (D) an anode-side gas-liquid separation chamber disposed in the anode-side non-current-flowing space and extending over the entire upper-side length of the anode compartment, and a cathode-side gas-liquid separation chamber disposed in the cathode-side non-current-flowing space and extending over the entire upper-side length of the cathode compartment, the anode-side and cathode-side gas-liquid separation chambers having perforated bottom walls partitioning the anode-side and cathode-side gas-liquid separation chambers from the anode compartment and the cathode compartment, respectively.

Further, it is noted that the conventional electrolytic cell is likely to exhibit a broad concentration distribution of an alkali metal chloride in the anolyte during the electrolysis when the internal pressure is at a level of reduced pressure or when the electrolysis temperature is as high as 90 ° C. or higher. By contrast, in a more preferred embodiment of the electrolytic cell of the present invention in which the unit cell is equipped with duct means 17 disposed therein, it is possible to attain a narrow concentration distribution of an alkali metal chloride in the anolyte.

As mentioned above, the bipolar, filter press type electrolytic cell of the present invention has many advantages which have not been attained by the conventional electrolytic cells. In the electrolysis using the electrolytic cell of the present invention, electrolysis conditions such as internal pressure, electrolysis temperature, current density and the like can be freely selected.

PREFERRED EMBODIMENT OF THE INVENTION

Hereinbelow, the present invention will be illustrated with reference to the following Examples and Comparative Examples, which however should not be construed as limiting the scope of the present invention.

EXAMPLE 1

A bipolar, filter press type electrolytic cell as shown in FIG. 4 is assembled, as described below.

In the electrolytic cell, five unit cells 25 of 2400 mm in width and 1280 mm in height are arranged in series through anode-side gasket 20, cation exchange membrane 19 and cathode-side gasket 21 which are disposed between respective adjacent unit cells to thereby form a stack. The stack is fastened by means of fastening frame 26. Two current lead plates 24, 24 are disposed on both sides of the stack. Voltage is applied to the unit cells through current lead plates 24, 24.

Each of the unit cells has a structure as shown in FIGS. 1, 2 and 3 (a diagrammatic front view of the unit cell is shown in FIG. 1; a diagrammatic cross-sectional view of the unit cell is shown in FIG. 2; and an enlarged, diagrammatic cross-sectional view of the upper portion of one of a pair of pan-shaped bodies of the unit cell is shown in FIG. 3). Referring to FIGS. 1, 2 and 3, each unit cell contains anode-side pan-shaped body 2A and cathode-side pan-shaped body 2B. Each of pan-shaped bodies 2A, 2B is comprised of partition wall 7, frame wall 8 extending from the periphery of partition wall 7 and upper and lower crooked flanges 9,9 each having a ⌐-shaped cross-section and respectively extending from the upper-side and lower-side portions of frame wall 8. Upper and lower crooked flanges 9,9 cooperate with the upper-side and lower-side portions of frame wall 8, respectively, to thereby form upper and lower recesses. Anode-side pan-shaped body 2A and cathode-side pan-shaped body 2B are disposed back to back, to thereby form upper and lower through-spaces respectively defined by the upper recesses of anode-side and cathode-side pan-shaped bodies 2A, 2B and the lower recesses of anode-side and cathode-side pan-shaped bodies 2A, 2B. Partition wall 7 of anode-side pan-shaped body 2A has anode 4 fixed thereto through a plurality of electrically conductive ribs 3 to form anode compartment 22 (see FIG. 4) with an anode-side non-current flowing space left above anode compartment 22 and below the upper-side portion of frame wall 8 of anode-side pan-shaped body 2A. On the other hand, partition wall 7 of cathode-side pan-shaped body 2B has cathode 4 fixed thereto through a plurality of electrically conductive ribs 3 to form cathode compartment 23 (see FIG. 4) with a cathode-side non-current-flowing space left above cathode compartment 23 and below the upper-side portion of frame wall 8 of cathode-side pan-shaped body 2B. Electrically conductive ribs 3 each have round holes 5 for the passage of an electrolytic solution and an electrolysis product. At the center portion of each of anode-side and cathode-side pan-shaped bodies 2A, 2B, as indicated in FIG. 1, reinforcing rib 11 having round holes (not shown) for the passage of an electrolytic solution and an electrolysis product is fixed by welding the rib to partition wall 7 and to the electrode [anode 4 in the case of anode-side pan-shaped body 2A and cathode 4 in the case of cathode-side pan-shaped body 2B]. Upper and lower engaging bars 1,1 are fittedly disposed in the above-mentioned upper and lower through-spaces, respectively, which serve to fasten anode-side and cathodeside pan-shaped bodies 2A, 2B back to back.

Anode-side gas liquid separation chamber 14 is disposed in the above-mentioned anode-side non-current-flowing space, which chamber extends over the entire upper-side length of anode compartment 22 (see FIGS. 1 and 4). Cathode-side gas-liquid separation chamber 14 is disposed in the above-mentioned cathode-side non-current-flowing space which chamber extends over the entire upper-side length of cathode compartment 23 (see FIGS. 1 and 4). Anode-side and cathode-side gas-liquid separation chambers 14,14 respectively have perforated bottom walls 6,6 partitioning anode-side and cathode-side gas-liquid separation chambers 14,14 from anode compartment 22 and cathode compartment 23, respectively.

With respect to materials, anode-side pan-shaped body 2A, anode-side gas-liquid separation chamber 14 and electrically conductive ribs 3 for use in anode compartment 22 are made of titanium. On the other hand, cathode-side pan-shaped body 2B, cathode-side gas-liquid separation chamber 14 and electrically conductive ribs 3 for use in cathode compartment 22 are made of nickel.

The cross-sectional area of gas-liquid separation chamber 14 is 15 $cm^2$. Gas-liquid separation chamber 14 is prepared by first bending a 3 mm-thick metal plate into an L-shape (a portion thereof forming the above-mentioned perforated bottom wall 6 while the other portion forming side wall 6') and then welding the edges of the plate to partition wall 7 and to crooked flange 9 as depicted in FIG. 3. In the case of gas-liquid separation chamber 14 for anode compartment 22, the metal is titanium. On the other hand, in the case of gas-liquid separation chamber 14 for cathode compartment 23, the metal is nickel. Perforated bottom walls 6,6 of gas-liquid separation chambers 14,14 have a plurality of holes 15 each having a diameter of 10 mm.

Each gas-liquid separation chamber 14 has, at one end thereof, gas and liquid outlet nozzle 13 having an inner diameter of 25 mm, which opens downwardly of bottom wall 6 of gas-liquid separation chamber 14.

Unit cell 25 is further provided, in anode compartment 22, with one duct means 17 serving as a path for the internal circulation of the electrolytic solution and disposed between the partition wall and the anode, the duct means having its upper opening 27 positioned below the gas-liquid separation chamber at a distance corresponding to 30% of the distance between the bottom wall and the bottom of the unit cell. Duct means 17 has a cross-sectional area of 20 $cm^2$ and is made of titanium.

Duct means 17 is rested on the bottom of anode compartment 22, and composed of a horizontal section having its opening 28 positioned on the side of electrolytic solution inlet nozzle 12 and a vertical section connected to the horizontal section and having opening 27 at its upper end.

Mixing box 18 made of titanium is disposed at a side of electrolytic solution inlet nozzle 12 of anode compartment 22 for mixing a supplied fresh electrolytic solution with a circulated electrolytic solution supplied from duct means 17. Mixing box 18 is connected to opening 28 of the horizontal section of duct means 17.

Anode-side pan-shaped body 2A and cathode-side pan-shaped body 2B are connected to each other back to back by spot welding through explosion-bonded titanium-iron plate 16. As mentioned hereinbefore, engaging bars 1,1 are respectively fittedly disposed in the upper and lower through-spaces defined by the upper recesses of anode-side and cathode-side pan-shaped bodies 2A, 2B and the lower recesses of anode-side and cathode-side pan-shaped bodies 2A, 2B, respectively. Engaging bars 1,1 are rod-shaped. Crooked flange 9 has hooked tip 10 fittedly inserted in a groove formed in each engaging bar 1.

The anode is prepared by expanding a titanium plate into an expanded mesh and then coating thereon an oxide containing ruthenium, iridium and titanium.

The cathode is prepared by expanding a nickel plate into an expanded mesh and then coating thereon a nickel oxide.

As the cation exchange membrane, use is made of cation exchange membrane ACIPLEX F-4100 manufactured and sold by Asahi Kasei Kogyo K.K., Japan.

The distance between each pair of an anode and a cathode is about 2.5 mm.

Using the thus assembled filter press type electrolytic cell, electrolysis is conducted while feeding a 300 g/liter saline solution to anode compartments 22 so that the sodium chloride concentration at the outlet of the electrolytic cell is 200 g/liter and while feeding a dilute aqueous sodium hydroxide solution to cathode compartments 23 so that the sodium hydroxide concentration at the outlet of the electrolytic cell is 33% by weight. The internal pressure of gas-liquid separation chamber 14 on the anode side (hereinafter referred to simply as "internal pressure of anode-side gas-liquid separation chamber 14") as measured in the gas phase within the chamber is 0.01 $kg/cm^2G$. The internal pressure of gas-liquid separation chamber 14 on the cathode side (hereinafter referred to simply as "internal pressure of cathode-side gas-liquid separation chamber 14") as measured in the gas phase within the chamber is 0.03 $kg/cm^2G$. Electrolysis is conducted at a temperature maintained at 90 ° C., while varying the current density. The voltage between unit cells, the vibration in gas-liquid separation chamber 14 on the anode side and the unevenness in the sodium chloride concentration within anode compartment 22, are measured with respect to each current density. Further, in order to determine any formation of a gas zone in the upper portion of anode compartment 22, an observing window is provided on the top portion of gas-liquid separation chamber 14 on the anode side at a distance of 100 mm from a closed end opposite to the end having outlet nozzle 13, so that the height of the level of the electrolytic solution is observed to thereby determine whether or not the level is positioned well above bottom wall 6 of gas-liquid separation chamber 14.

Vibration is determined by measuring pressure variations of the gas phase within gas-liquid separation chamber 14 on the anode side by means of analyzing recorder 3655E (manufactured and sold by Yokogawa Electric Corp., Japan). The difference between the maximum value and the minimum value of the pressure defines vibration.

The unevenness in the sodium chloride concentration of the anolyte (saline solution) is measured by sampling the anolyte at the following seven points of anode compartment 22, measuring the sodium chloride concentrations of the resultant samples and taking as the unevenness the absolute value of the difference between the maximum concentration and the minimum concentration. The seven sampling points consist of three points which are 150 mm below the upper side of anode compartment 22, one of which is at the middle of the distance between both lateral sides of the compartment and the other two of which are, respectively, at a distance of 100 mm from one lateral side and at a distance of 100 mm from the other lateral side; one point at the center of the compartment; and three points which are 150 mm above the lower side of anode compartment 22, one of which is at the middle of the distance between both lateral sides of the compartment and the other two of which are, respectively, at a distance of 100 mm from one lateral side and at a distance of 100 mm from the other lateral side.

The results are shown in Table 1.

Observations of the level of the electrolytic solution through the observing window during electrolysis show that the level of the electrolytic solution is well above the bottom of gas-liquid separation chamber 14 and at a height corresponding to nearly half of the vertical length of gas-liquid separation chamber 14, indicating that there is no formation of a gas zone in the upper portion of anode compartment 22. Thus, it is found that the state of the liquid in the gas-liquid separation chamber is good as observed from the observing window. Accordingly, electrolysis can be stably conducted irrespective of whether the current density is high or low.

COMPARATIVE EXAMPLE 1

Substantially the same procedure as described in Example 1 is repeated except that unit cells 25 are not provided with a gas-liquid separation chamber, and that in order to judge whether or not a gas zone is formed in the upper portion of an electrode compartment, observations are conducted during the electrolysis through an observing window which is provided on the top portion of the electrode compartment at a distance of 100 mm from the end thereof opposite to the end having an anolyte outlet nozzle.

By the observation, it is found that gas is resident in the upper portion of the compartment. When the electrolysis is continued for 30 days, no elevation of electrolysis voltage occurs during that period. However, when ion exchange membrane 19 is taken out thereafter, washed with water and examined, it is found that ion exchange membrane 19 has been discolored into a whitish color in a current passing area as large as 25 mm in the vertical direction and 550 mm in the horizontal direction, which area is positioned in the upper corner of the membrane on the side corresponding to the side of the cell opposite to the side having an anolyte outlet nozzle. This indicates that crystals of sodium chloride have been formed within the ion exchange membrane due to the presence of the resident gas. The results are shown in Table 1.

EXAMPLE 2

Substantially the same procedure as described in Example 1 is repeated except that at current densities of 45 A/dm$^2$ and 40 A/dm$^2$, hydrochloric acid is added to a fresh saline solution to be fed to anode compartment 22 in such an amount that hydrochloric acid has a final concentration of 0.08 mol/1. Electrolysis is continued for 30 days, and no elevation of electrolysis voltage is observed during that period. After the electrolysis, ion exchange membrane 19 is taken out, washed with water and examined. As a result, it is found that ion exchange membrane 19 has not suffered from any problems, such as discoloration and formation of water blisters (the water blister formation is a phenomenon presumably caused by the absorption of water at the time of washing when sodium chloride crystals are present in ion exchange membrane 19). The results are shown in Table 1.

EXAMPLE 3

Substantially the same procedure as described in Example 1 is repeated except that at current densities of 40 A/dm$^2$ and 45 A/dm$^2$, the internal pressure of anode-side gas-liquid separation chamber 14 is varied within the range of $-0.02$ kg/cm$^2$G to 0.5 kg/cm$^2$G while the internal pressure of cathode-side gas-liquid separation chamber 14 is maintained at a value which is 0.02 kg/cm$^2$G higher than the internal pressure of anode-side gas-liquid separation chamber 14.

As a result, it is found that there is no occurrence of leakage of liquid or gas from the electrolytic cell, and that the liquid level is well above bottom wall 6 of gas-liquid separation chamber 14 during electrolysis. This indicates that there is no formation of a gas zone in the upper portion of the electrode compartment. Thus, electrolysis can be stably conducted even at a high current density and a superatmospheric pressure. The results are shown in Table 2.

EXAMPLE 4

Substantially the same procedure as described in Example 1 is repeated except that at current densities of 40 A/dm$^2$ and 45 A/dm$^2$, electrolysis is conducted at a temperature varied within the range of from 80° to 92° C. while maintaining the internal pressure of anode-side gas-liquid separation chamber 14 at 0.01 kg/cm$^2$G and maintaining the internal pressure of cathode-side gas-liquid separation chamber 14 at a value 0.02 kg/cm$^2$G higher than the internal pressure of anode-side gas-liquid separation chamber 14. As a result, it is found that the liquid level is well above bottom wall 6 of gas-liquid separation chamber 14 during electrolysis, indicating that there is no formation of a gas zone in the upper portion of the electrode compartment. Thus, electrolysis can be stably conducted at a high current density over a wide range of electrolysis temperatures. The results are shown in Table 3.

EXAMPLE 5

Substantially the same procedure as described in Example 1 is repeated except that at a current density of 45 A/dm$^2$, $-0.02$ kg/cm$^2$ and 0.5 kg/cm$^2$G are individually employed as internal pressures of anode-side gas-liquid separation chamber 14 while maintaining the internal pressure of cathode-side gas liquid separation chamber 14 at a value which is 0.02 kg/cm$^2$ higher than the internal pressure of anode-side gas-liquid separation chamber 14, and that electrolysis temperatures are varied.

As a result, it is found that there is no occurrence of leakage of a liquid or gas from the cell, and that the liquid level is well above bottom wall 6 of gas-liquid separation chamber 14 during the electrolysis. This indicates that there is no formation of a gas zone in the upper portion of the electrode compartment. Thus, electrolysis can be stably conducted over a wide range of electrolysis temperatures, at a high current density and under a superatmospheric pressure as high as 0.5 kg/cm$^2$ or more. The results are shown in Table 4.

EXAMPLE 6

Substantially the same procedure as described in Example 1 is repeated except that the cross-sectional area of gas-liquid separation chamber 14 is 25 cm$^2$, and that the current density is 45 A/dm$^2$.

As a result, it is found that the electrolytic voltage per cell comprised of an anode compartment and a cathode compartment which are electrically connected is 3.33 V, that the vibration inside anode-side gas-liquid separation chamber 14 is 6 cm·$H_2O$(g/cm$^2$), and that the unevenness in the sodium chloride concentration of the anolyte is 45 g/1. Thus, electrolysis can be stably conducted without occurrence of any problems in the ion exchange membrane.

TABLE 1

| | Current density (A/dm$^2$) | Voltage (V) | Vibration (g/cm$^2$) | Unevenness* in sodium chloride concentration of an anolyte (g/l) | State of liquid level in gas-liquid separation chamber |
|---|---|---|---|---|---|
| Example 1 | 45 | 3.34 | 11 | 48 | Good** |
| | 40 | 3.25 | 5 | 40 | Good** |
| | 30 | 3.05 | 3 | 33 | Good** |
| | 20 | 2.84 | 1 | 27 | Good** |
| Comparative Example 1 | 45 | 3.40 | 55 | 92 | — |
| | 40 | 3.27 | 25 | 85 | — |
| Example 2 | 45 | 3.35 | 13 | 56 | Good** |
| | 40 | 3.26 | 8 | 53 | Good** |

*"Unevenness" means the difference between the maximum concentration and the minimum concentration.

**"Good" means that substantially uniform sufficient liquid level is observed in the gas-liquid separation chamber throughout the entire length thereof.

TABLE 2

| | Current density (A/dm²) | Internal pressure (kg/cm²G) | Voltage (V) | Vibration (g/cm²) | Unevenness* in sodium chloride concentration of an anolyte (g/l) | State of liquid level in gas-liquid separation chamber |
|---|---|---|---|---|---|---|
| Example 3 | 45 | 0.4 | 3.29 | 3 | 16 | Good** |
| | | 0.2 | 3.31 | 8 | 22 | Good** |
| | | −0.02 | 3.36 | 12 | 53 | Good** |
| | 40 | 0.5 | 3.21 | 1 | 11 | Good** |
| | | 0.2 | 3.24 | 2 | 15 | Good** |
| | | −0.02 | 3.27 | 7 | 42 | Good** |

*"Unevenness" means the difference between the maximum concentration and the minimum concentration.
**"Good" means that substantially uniform sufficient liquid level is observed in the gas-liquid separation chamber throughout the entire length thereof.

TABLE 3

| | Current density (A/dm²) | Electrolysis temperature (°C.) | Voltage (V) | Vibration (g/cm²) | Unevenness* in sodium chloride concentration of an anolyte (g/l) | State of liquid level in gas-liquid separation chamber |
|---|---|---|---|---|---|---|
| Example 4 | 45 | 92 | 3.32 | 11 | 57 | Good** |
| | | 85 | 3.37 | 12 | 26 | Good** |
| | | 80 | 3.42 | 15 | 12 | Good** |
| | 40 | 92 | 3.23 | 5 | 56 | Good** |
| | | 85 | 3.29 | 6 | 15 | Good** |
| | | 80 | 3.33 | 9 | 11 | Good** |

*"Unevenness" means the difference between the maximum concentration and the minimum concentration.
**"Good" means that substantially uniform sufficient liquid level is observed in the gas-liquid separation chamber throughout the entire length thereof.

TABLE 4

| | Internal pressure (Kg/cm²G) | Electrolysis temperature (°C.) | Voltage (V) | Vibration (g/cm²) | Unevenness* sodium chloride concentration of an anolyte (g/l) | State of liquid level in gas-liquid separation chamber |
|---|---|---|---|---|---|---|
| Example 5 | 0.5 | 92 | 3.27 | 2 | 36 | Good** |
| | | 85 | 3.33 | 2 | 11 | Good** |
| | | 80 | 3.38 | 5 | 8 | Good** |
| | −0.02 | 92 | 3.34 | 13 | 63 | Good** |
| | | 85 | 3.41 | 15 | 32 | Good** |
| | | 80 | 3.45 | 20 | 15 | Good** |

*"Unevenness" means the difference between the maximum concentration and the minimum concentration.
**"Good" means that substantially uniform sufficient liquid level is observed in the gas-liquid separation chamber throughout the entire length thereof.

What is claimed is:

1. A bipolar, filter press type electrolytic cell comprising a plurality of unit cells which are arranged in series through a cation exchange membrane disposed between respective adjacent unit cells, each unit cell comprising:

(A) an anode-side pan-shaped body, and (B) a cathode-side pan-shaped body, each of said pan-shaped bodies (A) and (B) comprising a partition wall, a frame wall extending from the periphery of the partition wall, and upper and lower crooked flanges having a -shaped cross-section and respectively extending from the upper-side and lower-side portions of said frame wall, said upper and lower crooked flanges cooperating with said upper-side and lower-side portions of the frame wall, respectively, to thereby form upper and lower recesses, said pan-shaped body (A) and pan-shaped body (B) being disposed back to back, to thereby form upper and lower through-spaces respectively defined by the upper recesses of said pan-shaped bodies (A) and (B) and the lower recesses of said pan-shaped bodies (A) and (B), said partition wall of the pan-shaped body (A) having an anode fixed thereto through a plurality of electrically conductive ribs to form an anode compartment with an anode-side non-current-flowing space left above said anode compartment and below said upper-side portion of the frame wall of said pan-shaped body (A), said partition wall of the pan-shaped body (B) having a cathode fixed thereto through a plurality of electrically conductive ribs to form a cathode compartment with a cathode-side non-current-flowing space left above said cathode compartment and below said upper-side portion of the frame wall of said pan-shaped body (B), (C) upper and lower engaging bars fittedly disposed in said upper and lower through-spaces, respectively, and serving to fasten said pan-shaped bodies (A) and (B) back to back, and (D) an anode-side gas-liquid separation chamber disposed in said anode-side non-current-flowing space and extending over the entire upper-side length of said anode compartment, and a cathode-side gas-liquid separation chamber disposed in said cathode-side non-current-flowing space and extending over the entire upper-side length of said cathode compartment, said anode-side and cathode-side gas-liquid separation chambers having perforated bottom walls partitioning said anode-side an cathode-side gas-liquid separation chambers from said anode compartment and said cathode compartment, respectively.

2. The electrolytic cell according to claim 1, wherein each gas-liquid separation chamber has a cross-sectional area of not smaller than 15 $cm^2$.

3. The electrolytic cell according to claim 1, wherein each gas-liquid separation chamber has a vertical length in cross-section in the range of from 4.0 to 10 cm and a lateral length in cross-section which is greater than 1.5 cm but less than the lateral depth of each of the anode compartment and cathode compartment.

4. The electrolytic cell according to claim 1, wherein the bottom wall of each gas-liquid separation chamber has a thickness in the range of from 1.0 to 10 mm and has a perforation ratio in the range of from 5 to 90%, based on the area of the bottom wall.

5. The electrolytic cell according to claim 1, wherein each gas-liquid separation chamber has, at one end thereof, a gas and liquid outlet nozzle which opens downwardly of the bottom wall of the gas-liquid separation chamber.

6. The electrolytic cell according to claim 1, wherein each gas-liquid separation chamber has, at one end thereof, a gas and liquid outlet nozzle having an inner diameter, as measured at its portion connected to the gas-liquid separation chamber, which is at least 15 mm but smaller than the lateral depth of each of the anode compartment and cathode compartment.

7. The electrolytic cell according to claim 1, wherein each unit cell further comprises, in at least one of the anode compartment and cathode compartment, at least one duct means serving as a path for the internal circulation of an electrolytic solution and disposed between the respective partition wall and at least one of the anode and cathode, said duct means having its upper opening positioned below said gas-liquid separation chamber at a distance corresponding to 20 to 50% of the distance between the bottom wall and the bottom of the unit cell and having its lower open end positioned near the bottom of the unit cell and supported by supporting means.

8. The electrolytic cell according to claim 1, wherein each unit cell further comprises, in at least one of the anode compartment and cathode compartment, at least one duct means serving as a path for the internal circulation of an electrolytic solution and disposed between the respective partition wall and at least one of the anode and cathode, said duct means being rested on the bottom of at least one of the anode compartment and cathode compartment and comprising:

a horizontal section having its opening positioned on the side of an electrolytic solution inlet nozzle; and at least one vertical section connected to said horizontal section and having an opening at its upper end positioned below said gas-liquid separation chamber at a distance corresponding to 20 to 50% of the distance between the bottom wall and the bottom of the unit cell.

9. The electrolytic cell according to claim 1, wherein each unit cell further comprises, at least in the anode compartment of the anode and cathode compartments, at least one duct means serving as a path for the internal circulation of an electrolytic solution and disposed between the respective partition wall and at least the anode of the anode and cathode, and comprises, in the anode compartment, a mixing box disposed at an inlet side of an electrolytic solution inlet nozzle of the anode compartment for mixing a supplied fresh electrolytic solution with a circulated electrolytic solution supplied from said duct means, wherein said mixing box is connected to the lower opening of at least one of said one duct means.

10. The electrolytic cell according to claim 1, wherein said frame wall of each of said pan-shaped bodies (A) and (B) has lateral crooked flanges having a ⌐-shaped cross-section and respectively extending from both lateral-side portions of said frame wall, said lateral crooked flanges cooperating with the corresponding lateral portions of the frame wall, respectively, to thereby form lateral recesses, said lateral recesses of the pan-shaped body (A) cooperating with said lateral recesses of the pan-shaped body (B) to thereby form a pair of lateral through-spaces in accordance with the back-to-back disposition of said pan-shaped bodies (A) and (B), said pair of through-spaces having engaging bars vertically, fittedly disposed therein, respectively.

11. The electrolytic cell according to any one of claims 1 to 10, wherein said crooked flange has a hooked tip fittedly inserted in a groove formed in each engaging bar.

* * * * *